US005765953A

United States Patent [19]

Takahashi

[11] Patent Number: 5,765,953

[45] Date of Patent: Jun. 16, 1998

[54] CONTROL DEVICE OF ENERGY SUPPLY FOR HEATING ELEMENTS OF A THERMAL HEAD AND METHOD FOR CONTROLLING ENERGY SUPPLY FOR SAID HEATING ELEMENTS

[75] Inventor: Hiroo Takahashi, Tokyo, Japan

[73] Assignee: NEC Corporation, Tokyo, Japan

[21] Appl. No.: 558,774

[22] Filed: Nov. 15, 1995

[30] Foreign Application Priority Data

Nov. 16, 1994 [JP] Japan ..... 6-282329

[51] Int. Cl.[6] ..... B41J 2/36

[52] U.S. Cl. ..... 400/120.09; 400/120.15; 347/184; 347/188

[58] Field of Search ..... 400/120.15, 120.07, 400/120.09, 120.01; 347/191, 195, 184, 188

[56] References Cited

U.S. PATENT DOCUMENTS

| | | | |
|---|---|---|---|
| 4,679,055 | 7/1987 | Inui et al. | 347/195 |
| 4,801,948 | 1/1989 | Kato | 347/191 |
| 4,827,281 | 5/1989 | Lubinsky et al. | 347/195 |
| 4,870,428 | 9/1989 | Kuwabara et al. | 347/195 |
| 4,955,736 | 9/1990 | Iwata et al. | 347/195 |
| 5,038,154 | 8/1991 | Yamamoto et al. | 347/195 |
| 5,115,252 | 5/1992 | Sasaki | 347/195 |
| 5,131,767 | 7/1992 | Yamada et al. | 400/120.07 |
| 5,160,941 | 11/1992 | Fujiwara et al. | 347/184 |
| 5,248,995 | 9/1993 | Izumi | 347/195 |
| 5,264,866 | 11/1993 | Nagahisa | 347/195 |
| 5,548,688 | 8/1996 | Wiklof et al. | 347/195 |

FOREIGN PATENT DOCUMENTS

| | | | |
|---|---|---|---|
| 226360 | 9/1989 | Japan | 400/120.11 |

*Primary Examiner*—John S. Hilten
*Assistant Examiner*—Steven S. Kelley
*Attorney, Agent, or Firm*—Sughrue, Mion, Zinn, Macpeak & Seas, PLLC

[57] ABSTRACT

A control device which controls the supply of energy heating elements of a thermal head. The control device to a memory includes for storing multiplication results as correction energy values of combinations of influence parameters, each of the influence parameters indicating a degree of influence caused by a reference heating element on a targeted heating element, and all energy values that can be supplied to reference heating elements. The control device also includes an address generation section for specifying a reference heating element that affects the targeted heating element based on printing data and generating an address based on a combination of the influence parameter of the reference heating element and the energy value that was supplied to the reference heating element and a memory control section for reading out a correction energy value from the memory based on the generated address.

10 Claims, 12 Drawing Sheets

(f×R) f=0～63, R=0.1～0.9

| R \ f | 0 | 1 | ····· | 63 |
|---|---|---|---|---|
| 0.1 | 0 | 0.1 | ····· | 6.3 |
| 0.2 | 0 | 0.2 | ····· | 12.6 |
| ⋮ | ⋮ | ⋮ | | ⋮ |
| 0.9 | 0 | 0.9 | ····· | 56.7 |

(β×b) B=0.03, b=0～63

| β \ b | 0 | 1 | ····· | 63 |
|---|---|---|---|---|
| 0.03 | 0 | 0.03 | ····· | 1.89 |

FIG. 17

| POWERING TIMING SELECT CASE STORING POSITION | t I → | t II → | t III → | t IV → | t I → | t II → · · · |
|---|---|---|---|---|---|---|
| | CASE 1 → | CASE 2 → | CASE 3 → | CASE 4 → | CASE 1 → | CASE 2 → · · · |
| b: | -1 | -1 | -1 | -1 | -1 | -1 |
| c: | -1 | -1 | -1 | -1 | -1 | -1 |
| d: | +0 | +0 | +0 | +0 | +0 | +0 |
| e: | +1 | +1 | +1 | +1 | +1 | +1 |

CONTROL DEVICE OF ENERGY SUPPLY FOR HEATING ELEMENTS OF A THERMAL HEAD AND METHOD FOR CONTROLLING ENERGY SUPPLY FOR SAID HEATING ELEMENTS

BACKGROUND OF THE INVENTION

The present invention relates a thermal head for information heat recording on a thermosensible recording paper. More specifically, then present invention relates to an art for controlling an energy supply to each heating element of a thermal head based on a heating history.

There has been a problem that if the past heating histories of a targeted heating element and reference elements in the vicinity of the targeted heating element are not properly considered, a desired printing scale may not be obtained when determining energy supply value for the targeted heating element that is to be operated in a thermal head that selectively heats a plurality of heating elements, because the targeted heating element is excessively heated by accumulated heat.

For the above-stated reason, conventional thermal head heat controlling takes into account heating history to control an energy supply value for the targeted heating element.

By way of example, the art disclosed in Japanese Patent Laid Open No. 270976 (1986) can be listed up. In this art, when determining a powering pulse width to a targeted heating element scale information which is to be printed for heating elements in the vicinity of the targeted heating element is checked. Subsequently, an influence parameter of the adjacent heating elements affecting the targeted heating element is calculated based on the scale information. Thereafter, an energy supply for the targeted heating element is controlled using the influence parameter. The above-described control of a heating element is conducted through software calculation with a microprocessor.

In order to increase calculation accuracy in the prior art disclosed in Japanese Patent Laid Open No. 270976 (1986), a sophisticated calculation including decimal numbers having many decimal digits must be conducted. In this calculation, multiplication operation is necessary, so the structure of operation means, especially that of multiplier becomes more sophisticated than the case of calculating addition or subtraction. In addition, processing time of operation thereof is also becomes longer, as a result, it is difficult to speed up printing operation.

In general, when heat printing using aligned heating elements which are simultaneously energized, a powering timing of all heating elements is the same and all heating elements are energized at once. In this case, it is known that it is possible to uniquely correct the energy value to be supplied to the targeted heating element from a combination of the existence of a past energizing of the targeted heating element and that of a past energizing of adjacent heating elements on the previous line. For example, in FIG. 19 a heating element that was not energized is represented by a white circle and a heating element that was energized is represented by a black circle. The energy value to be supplied to the targeted heating element is obtained using heating histories (existence of energizing) of heating elements in an area surrounded by the broken line. The reason is that influence parameters of heat accumulation of adjacent heating elements A and B that affect the targeted element are the same for each, as the energizing timing of all of the aligned heating elements are same.

Art which is similar to that which is described above is disclosed in Japanese Patent Laid Open No. 257066 (1989).

In this art, in a thermal head, an influence to a targeted heating element caused by heat accumulation of adjacent heating elements is considered and a heat accumulation correction pattern of the targeted heating element is calculated. Then, the results are stored in advance in a table memory. Then, the existence of energizing of an adjacent heating element to the targeted heating element prior to printing is checked based on printing data thereafter, a pattern of existence of energizing is specified, and a heat accumulation correction pattern is read out from the table memory. The read out heat accumulation correction pattern is converted to an analog voltage with a digital to analog conversion circuit, thus an energy value to be supplied is determined.

This art enables a heat accumulation correction pattern to be obtained without calculation because it reads out the heat accumulation correction pattern from a memory when determining an energy value to be supplied to the targeted heating element.

However, this heat accumulation correction pattern does not consider dispersion of resistance of each heating element, so it may not provide a desired printing scale. In addition, this prior art needs a digital to analog conversion circuit and other types of analog circuits. Therefore, it is necessary to seriously consider how the dispersion of these components will be structured in each circuit, and how the resulting circuit will account for temperature variations. Accordingly, it is necessary to consider temperature compensation of circuits. In case of a line thermal printer that needs thousands of heating elements, the number of circuit elements becomes huge. This is a disadvantage in cost.

SUMMARY OF THE INVENTION

It is an object of the present invention to solve the above-mentioned problems.

It is an object of the present invention to provide apparatus and method an for controlling heating of a thermal head enabling high speed heat history correction of each heating element and to obtain a desired printing scale which is accurate.

The object of the present invention is achieved by a control device which supplies energy to heating elements of a thermal head. More specifically, the control device controls the supply of energy to a targeted heating element that prints by referring to heating histories of reference heating elements in the vicinity of the targeted heating element. The control device comprises storing means for storing multiplication results as correction energy values representing combinations of all influence parameters, each of the influence parameters indicating a degree of influence caused by a respective one of the reference heating elements on the targeted heating element, and all energy values which can be supplied to each of the heating elements, and reading means for specifying a reference heating element that affects the targeted heating element based on printing data, and for reading out one of the correction energy values from the storing means based on a combination of one of the influence parameters of the reference heating element and a corresponding energy value supplied to the reference heating element.

In the present invention, an influence parameter is calculated based on a clearance between a reference heating element that was energized and the targeted heating element a time difference between the time when each heating element was energized and the time when the targeted heating element is energized. By calculating the influence parameter in this manner, a real heat accumulation condition is accurately estimated because an influence of a heat accumulation of a heating element having a large energy value and that of a heat accumulation of a heating element located near the targeted heating element are estimated more accurately.

In addition, correction energy values corresponding to all combinations of the influence parameters and all heating elements are stored in advance in a memory, so that it is not necessary to calculate a correction energy value at each time. Reading out of the correction energy values is more speedy than that of conventional operation of correction energy values, so that the printing speed also can be increased.

If numerical data uniquely calculated from an energy value supplied to each heating element and an influence parameter corresponding to the energy value are stored in a memory, desired correction energy value can be rapidly and easily extracted.

In addition, by calculating a fundamental energy value in a case in which a past heating history of a heating element has been ignored and calculating difference values by subtracting each correction energy value from the fundamental energy value, a more accurate scale is printed because heat accumulated in the targeted heating element is subtracted.

In setting the energy value to a pulse width of an electric pulse supplied to a heating element, calculation speed is increased because the pulse width can be directly obtained, otherwise, additional conversions or operations are necessary in order to determine the energy value.

Moreover, if an required individual resistance correction coefficient is calculated in advance by dividing the resistance of the heating element with an average resistance value per a line and multiplying the result by the individual resistance correction coefficient corresponding to the above-mentioned fundamental energy value, it is possible to obtain extremely accurate correction value where dispersion of heating element is considered.

In general, electric power is used for the above-mentioned energy. However, other types of power can be used such as magnetic power, etc.

BRIEF DESCRIPTION OF THE DRAWINGS

This and other objects, features and advantages of the present invention will become more apparent upon a reading of the following detailed description and drawings, in which:

FIG. 17 is a figure for explaining powering timing and storing position of scale data;

DESCRIPTION OF THE PREFERRED EMBODIMENTS

The preferred embodiments of the present invention are hereinafter described.

Figure 1:
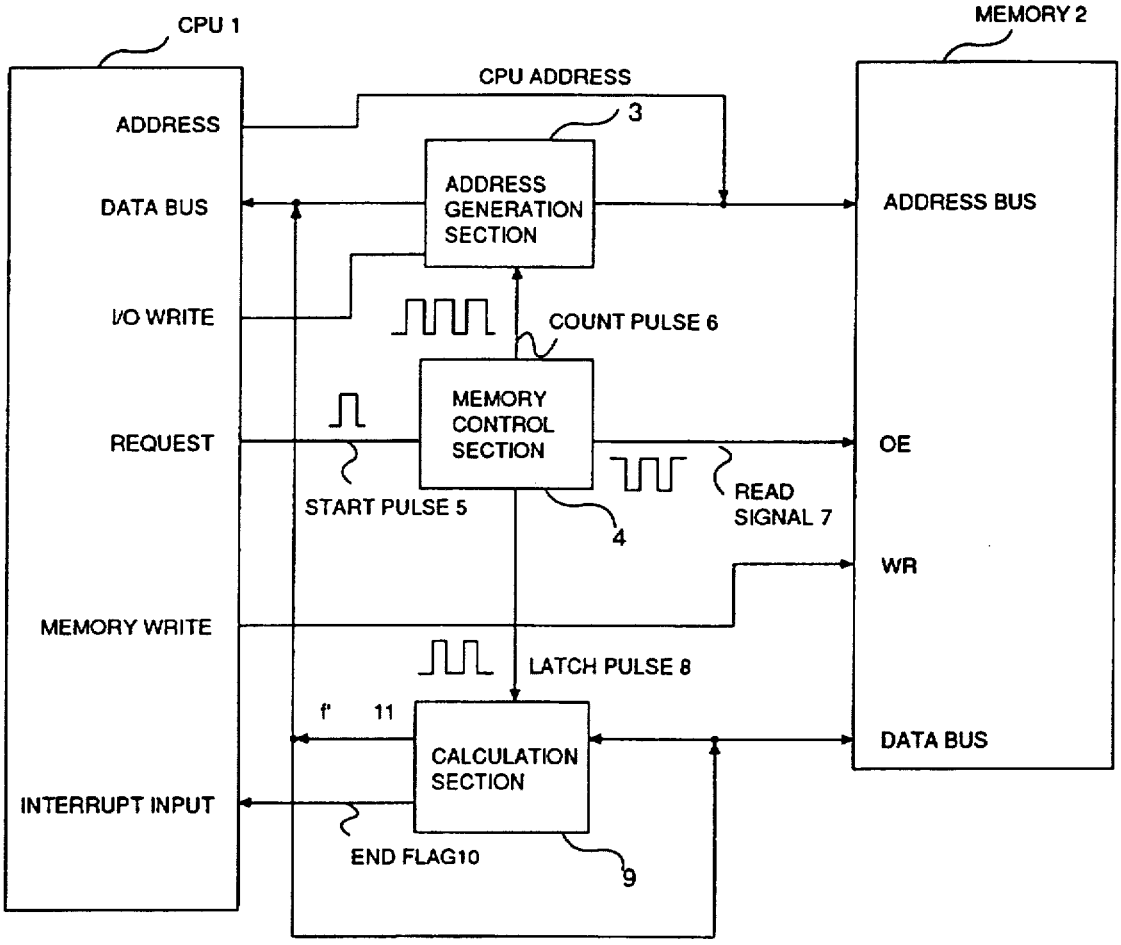
FIG. 1 illustrates a schematic construction view of a control device of energy supply for heating elements of a thermal head of the first embodiment of the present invention.

FIG. 1 is a schematic construction view of a control device of energy supply for heating elements of a thermal head according to an embodiment of the present invention. The control device represents an example of the use of correcting heating history at every heating element. Referring to FIG. 1, a reference numeral 1 corresponds to a CPU, 2 corresponds to a memory (memory for storing correction energy value), 3 corresponds to an address generation section, 4 corresponds to a memory control section and 9 corresponds to a calculation section. The CPU 1 controls the operation of the respective sections of the control device as a core processor in accordance with predetermined programs. The memory 2 contains current 1-dot line data supplied to the thermal head, 1-line and 2-lines precedent 1-dot line data as well as arithmetic parameters described later.

The operation of the above-constructed heating controller of the thermal head is described below.

Figure 2:
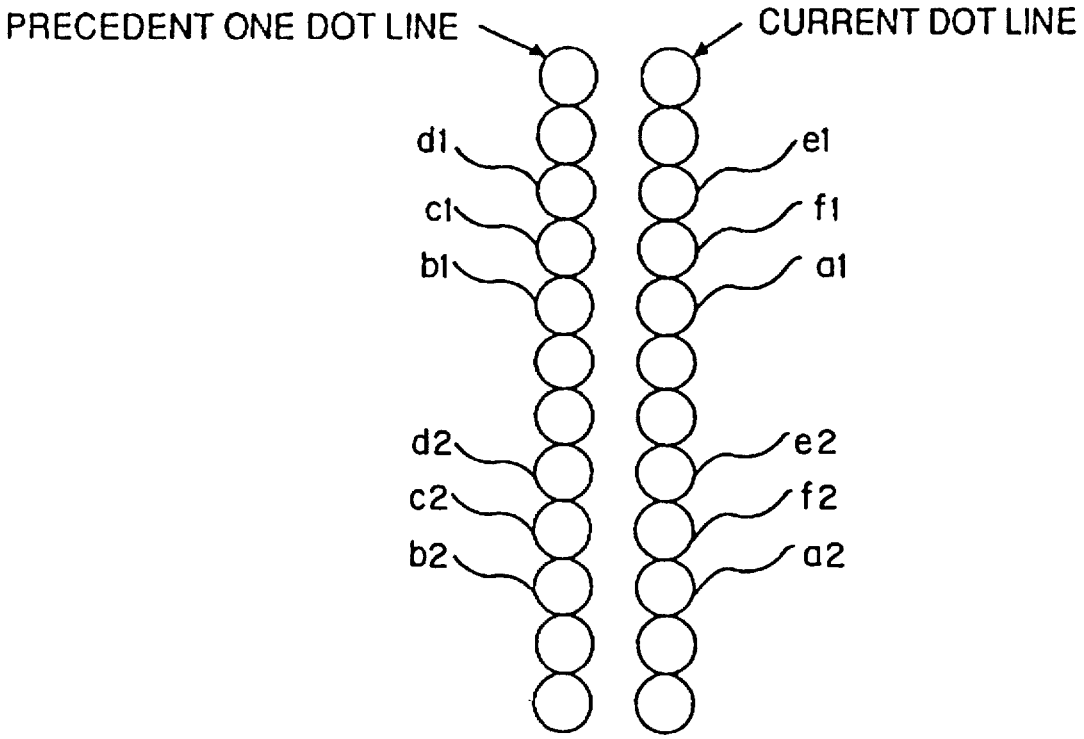
FIG. 2 is a figure for explaining a relation between a targeted heating element and adjacent heating elements in connection with a heating history calculation.
Figures 3A, 3B, 3C, 3D, 3E:
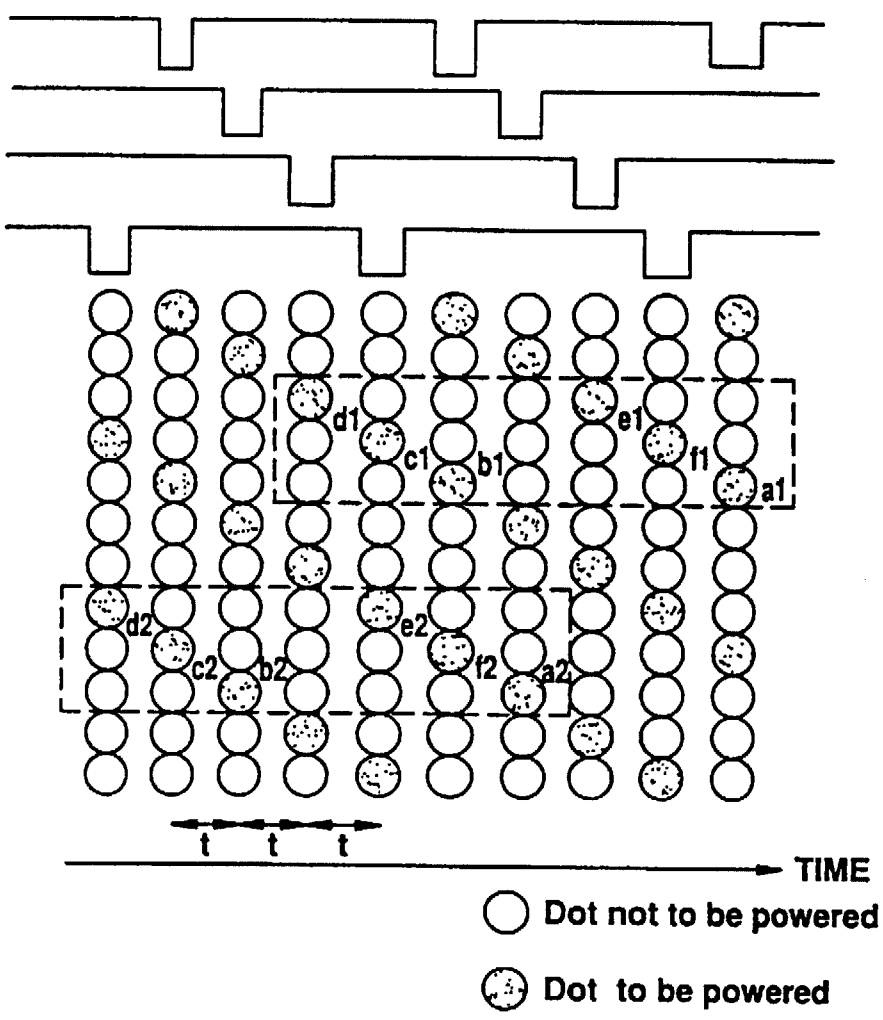
FIG. 3 is a figure for explaining powering timing in case that the one dot line printing powering timing is at every 4 dot in the present embodiment.

Referring to FIGS. 2 and 3, a method for obtaining the heating history at every heating element is described.

In FIG. 2, it is assumed that a powering energy value of a targeted heating element is designated as "f", powering energy values of heating elements next to the targeted heating element (reference heating elements) are designated as "a" and "e", respectively. It is also assumed that powering energy values of "a", "f" and "e" 1-line precedent (past) are designated as "b", "c" and "d".

This embodiment uses the powering energy value as the power pulse width at powering. The respective influence parameters indicating influence of "a", "b", "c", "d" and "e" to the targeted heating element "f" are designated as $\alpha$, $\beta$, $\gamma$, $\delta$ and $\epsilon$, respectively.

If the powering timing for printing every heating element line is at every 4 heating elements as shown in FIG. 3, the influence of parameters $\alpha 1$, $\beta 1$, $\gamma 1$, $\delta 1$ and $\epsilon 1$ affecting the targeted heating element f1 that are associated with A1, b1, c1, d1 and e1 take on different values. Assuming that the powering interval is designated as "t", there is a time interval of 5t between the application of the powering energy values "d1" and "f1" to their associated heating elements. The time interval between the application of the powering energy values is likewise 4t and between the application of the powering energy value is 3t, respectively. The shorter the powering time interval becomes, the greater the influence of each energy value on "f1" becomes. Therefore, the parameter value of $\gamma 1$ is greater than the $\delta 1$. The $\beta 1$ has likewise the greater parameter value than that of $\gamma 1$.

Supposing that the targeted heating element associated with the powering energy value "f2", and the influence parameters affecting "f2" that are associated with the powering energy values "a2", "b2", "c2", "d2" and "e2" are $\alpha 2$, $\beta 2$, $\gamma 2$, $\delta 2$ and $\epsilon 2$, respectively. In FIG. 3, if the powering timing t at every 4 heating elements is constant, the following relationships are obtained:

$\alpha 1=\alpha 2$, $\beta 1=\beta 2$, $\gamma 1=\gamma 2$ $\delta 1=\delta 2$, $\epsilon 1=\epsilon 2$ where $\alpha n \neq \beta n \neq \gamma n \neq \delta n \neq \epsilon n$ (n=1, 2). It is clear that the longer the time interval passes from the targeted heating element, the smaller the influence to heat accumulation becomes, thus decreasing the coefficient value.

It is assumed that an individual resistance correction coefficient R is obtained from subtracting an average resistance value of the thermal head from the resistance value of the targeted heating element. The above-obtained value allows for the consideration of individual resistance value corrections for the respective heating elements, resulting in finer adjustment in the powering energy values. This is especially true for a sublimation type printing unit which serves to correct dispersion in the resistance value of the heating element. Therefore, this unit provides uniform printing scale, leading to the finest scale expression.

When designating a target energy value "f" of the energy supplied to the targeted heating element after accounting for the heating history, the required equation for calculating the heating history is expressed as follows:

$$f=(f\times R)-(\alpha\times a)-(\beta\times b)-(\gamma\times c)-(\delta\times d)-(\epsilon\times e) \quad (1)$$

Compared with the target energy value "fn" (n=1,2) associated with the targeted heating element In=1 (n=1, the heating element associated with the powering energy value "an" (n=1, 2) is powered after the targeted heating element. That is, since the "an" is expected to be powered after powering the targeted heating element "fn", relationship $\alpha 1=\alpha 2=0$ is obtained. So the above equation is actually expressed as follows:

$$f=(f\times R)-(\beta\times b)-(\gamma\times c)-(\delta\times d)\times(\epsilon\times e) \quad (2)$$

An explanation about the address generation section 3 is described below.

The following description concerns relationship between calculation procedure of the equation (2) and the address generation section 3.

| [Procedure] | [Operation of address generation section 3] |
|---|---|
| Read f | Output f read address. Latch result. |
| Read R | Output R read address. Latch result. |
| Read (f×R) | Output (f×R) read address by combining read results of f and R. |

-continued

| [Procedure] | [Operation of address generation section 3] |
|---|---|
| Read β | Output β read address. Latch result. |
| Read b | Output b read address. Latch result. |
| Read (β×b) | Output (β×b) read address by combining read results of β and b. |
| Read γ | Output γ read address. Latch result. |
| Read c | Output c read address. Latch result. |
| Read (γ×c) | Output (γ×c) read address by combining read results of γ and c. |
| Read δ | Output δ read address. Latch result. |
| Read d | Output d read address. Latch result. |
| Read (δ×d) | Output (δ×d) read address by combining read results of δ and d. |
| Read ϵ | Output ϵ read address. Latch result. |
| Read e | Output e read address. Latch result. |
| Read (ϵ×e) | Output (ϵ×e) read address by combining read results of ϵ and e. |

The address generation section 3 automatically generates addresses upon reading parameters required for calculating the equation (2) from the memory. A more detailed explanation of the address generation section 3 is described below.

This explanation assumes that the memory 2 writes 0 data from the CPU 1 prior to actuating the circuit of the present invention so as to zero clear the whole area. By way of example, the thermal head is assumed to contain 2048 heating elements. The term Hex denotes a hexadecimal code.

First, a data storing method for memory 2 is explained.

(1) Writing printing data of the current line, 1-line precedent, 2-lines precedent to the memory 2:

The CPU 1 is used to write the line printing data to the memory 2.

The printing data of 1 heating element (scale data) is equivalent to 1 byte and is stored at a particular memory address. Since 2048 heating elements are contained, sufficient area for storing the respective lines ranges from 0 Hex to 7 FF Hex address.

Figures 4, 5:
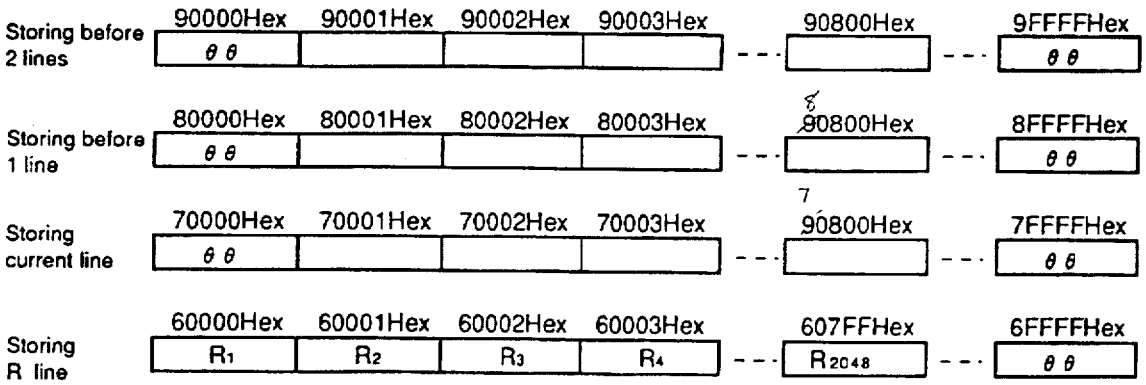
FIG. 4 is a figure for showing a condition of storing line data, etc. in the memory 2.
FIG. 5 is a figure for explaining a multiplication term of a heating history expression in the present embodiment.

FIG. 4 is a schematic view representing line data and individual resistance correction coefficient R (described later) stored in the memory 2. At present, the line printing data are stored in the area from 70001 Hex to 70800 Hex address. The 1-line precedent printing data are stored in the area from 80001 Hex to 80800 Hex address. The 2-lines precedent printing data are stored in the area from 90001 Hex to 90800 Hex address.

(2) Writing individual resistance correction coefficient R to the memory 2

The CPU 1 functions in writing the individual resistance correction coefficient R to the memory 2.

This coefficient is obtained from subtracting an average resistance value of the thermal head from the resistance value of the heating element subjected to correction, which is a decimal value. For example, supposing that a certain heating element has its individual resistance value of 3540 Ω and average resistance value of the respective heating elements of 3800 Ω, the following equation is obtained:

$$R=3540\ \Omega/3800\ \Omega=0.9$$

In the present invention, the decimal value is converted into corresponding hexadecimal value and stored in the memory as follows.

$$R=0.9\rightarrow 09\ Hex,\ R=1.2\rightarrow 12\ Hex$$

The coefficient R of every heating element is expressed as 1 byte and stored at a particular memory address. Since there are 2048 heating elements, sufficient storing area ranges from 0 Hex to 7 FF Hex address. FIG. 4 indicates that the individual resistance correction coefficient R is stored in the area ranging from 60000 Hex to 607 HH Hex address.

(3) Writing heat accumulation influence parameters β, γ, δ, ϵ to the memory 2:

The CPU 1 functions in writing heat accumulation influence parameters β, γ, δ and ϵ to the memory 2.

These heat accumulation influence parameters β, γ, δ and ϵ are actually decimal values, for example, β=0.03, γ=0.01, δ=0.03 and ϵ=0.05. In this embodiment, each parameter was converted into corresponding hexadecimal value and stored in the memory as follows:

β=07 Hex

γ=01 Hex

δ=03 Hex

ϵ=05 Hex

These parameters β, γ, δ and ϵ are expressed as 1 byte data, respectively and stored at a particular the memory address. Since there are 4 kinds of heat accumulation influence parameters of β, γ, δ and ϵ, they can be stored in the area ranging from 0 Hex to 3 Hex address. Therefore the heat accumulation influence parameters β, γ, δ and ϵ are stored in the area ranging from 00000 Hex to 00003 Hex address.

(4) Storing left sides of the equation (2), (f×R), (β×b), (δ×c), (ϵ×c) to the memory 2:

The CPU 1 functions in writing data to the memory 2.

All the parameters in parentheses of f, R, β, b, γ, c, δ, d, ϵ and e are known as being within the limited range. So as shown in FIG. 5, each range covering parameters are listed as follows. For example, in case of (f×R):

| | |
|---|---|
| the range for storing f: f = 0–63 | 64 kinds. |
| the range for storing R: R = 0.1–0.9 | 9 kinds |
| Resultant kinds of (f×R) = 64×9 | 576 kinds |

In case of (β×b):

| | |
|---|---|
| the range for storing β: β = 0.03 | 1 kind |
| the range for storing b: b = 0–63 | 64 kinds |
| Resultant kind of (β×b) = 1×64 | 64 kinds |

Next the method for storing (f×R), (β×b), (γ×c), (δ×d) and (ϵ×e) is described.

Two parameter values for multiplication are converted into corresponding hexadecimal values. Then the address used for combining hexadecimal codes and storing the same in the memory is determined. For example, in case of (f×R), f=32 Hex. In case of R=0.9, R=09 Hex.

Therefore the storing point of the (f×R)×45 (2D×Hex) with f=scale data of 50 and R=0.9 is derived from combining 32 Hex and 09 Hex, resulting in 3209 Hex address.

In order to distinguish the store points among (f×R), (β×b), (γ×c), (δ×d) and (ϵ×e), the index address bit is added to the most significant address as follows.

Figure 6:
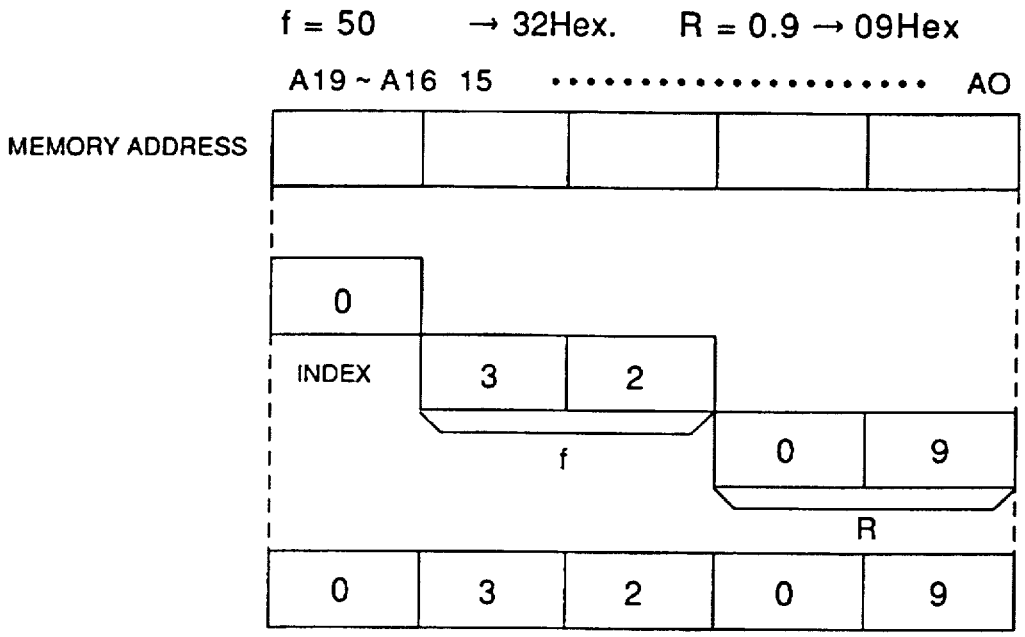
FIG. 6 is a figure for explaining address generation method in the present embodiment.

Examples:

(f×R) index address bit 0 Hex (β×b) index address bit 1 Hex (γ×c) index address bit 2 Hex (δ×d) index address bit 3 Hex (ϵ×e) index address bit 4 Hex Supposing that f=scale data value of 50 and R=0.9, the store point of the (f×R)=50×0.9=45 (2D Hex in hexadecimal) is determined by adding the index address bit 0 Hex to 3209 Hex, resulting in 30209 Hex address. FIG. 6 shows a graphical representation in case of f=scale data of 50 and R=0.9.

Figure 7:
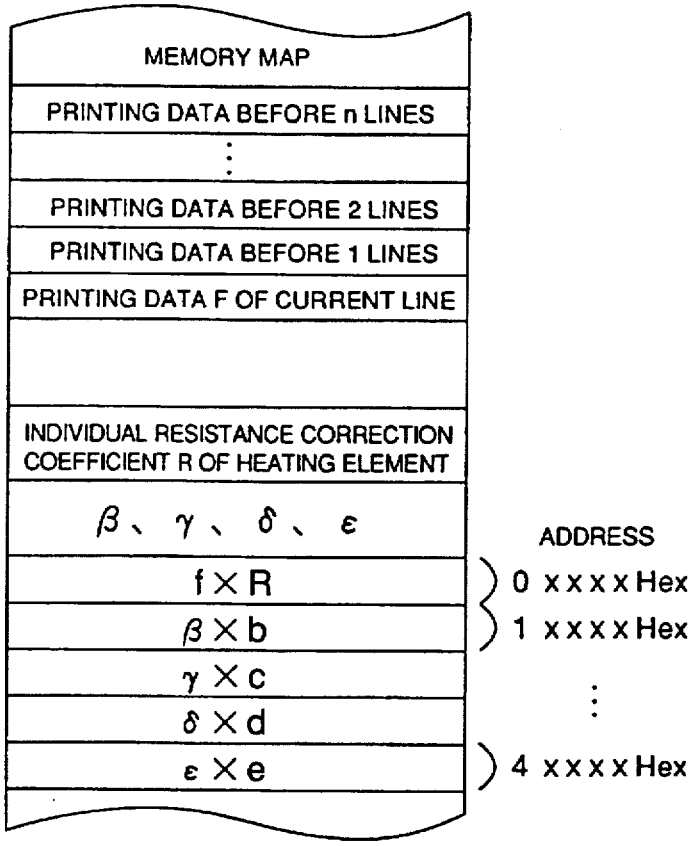
FIG. 7 illustrates a model view for explaining memory structure in the present embodiment.

FIG. 7 shows a model view of mapping on the memory 2 in accordance with the above-described methods (1) to (4). A function of the address generation section 3 is described.

Figure 8:
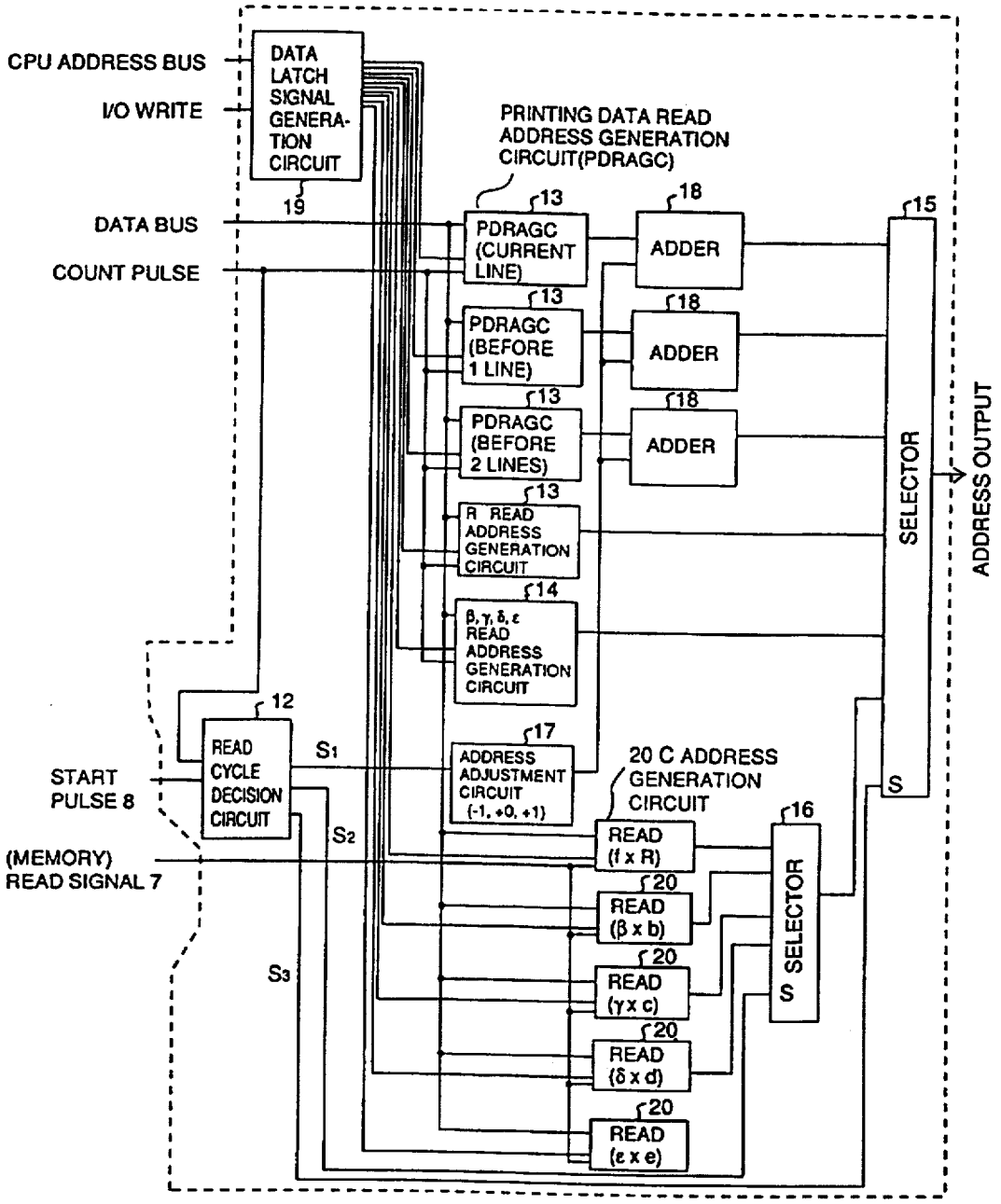
FIG. 8 is a block diagram of an internal construction view of the address generation section 3.

FIG. 8 is an internal construction view of the address generation section 3.

A reference numeral 19 denotes a data latch signal generation circuit for generating a latch signal based on the address from the CPU 1 and I/O light signal so that the latch circuit used in each part of the address generation section maintains the CPU 1 data.

A reference numeral 12 is a read cycle decision circuit for generating selection signals S1, S2 and S3 based on the actuation pulse from the CPU1 and count pulses from the memory control section 4. The selection signals S1, S2 and S3 are connected to the respective selector circuits so as to output the address responding to the read cycle of each parameter based on the procedure of the equation (2).

Figure 9:
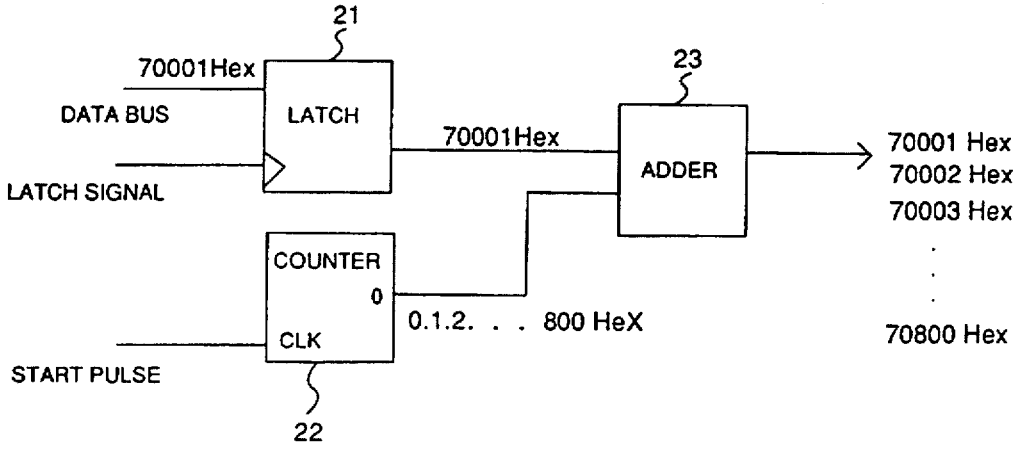
FIG. 9 is a block diagram of a read address generation circuit 13.

A reference numeral 13 denotes a read address generation circuit. FIG. 9 shows the printing data read address generation circuit 13 for the current line. More specifically the read address generation circuit 13 writes the address from where storing starts to the latch 21 from the CPU 1. The counter 22 counts up at every actuation pulse generation from the CPU 1. The counter 22 is able to count up 2048 or more. An adder 23 adds an output of the latch 21 to the output of the counter 22. Each construction of the read address generation circuit 13 of 1-line precedent, 2-lines precedent and R has the same construction as shown in FIG. 9.

Figure 10:
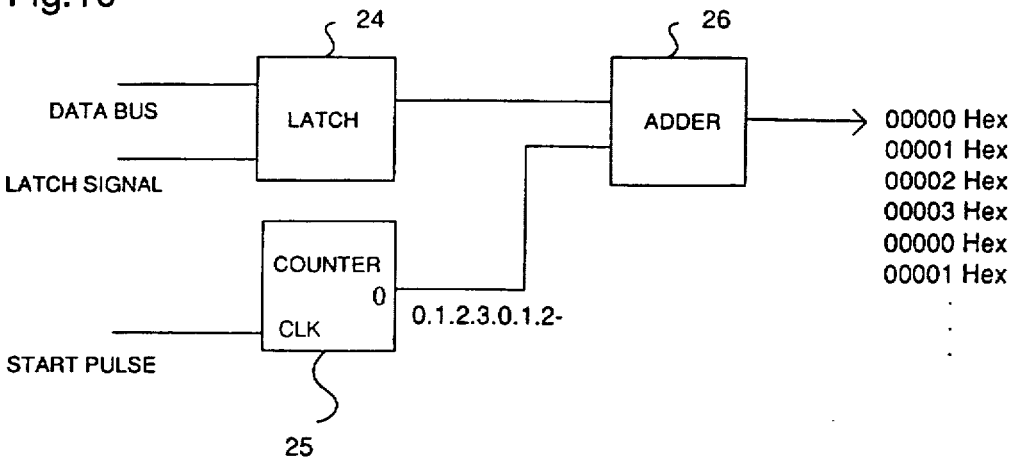
FIG. 10 is a block diagram of a read address generation circuit 14.

A reference numeral 14 denotes each read address of β, γ, δ, ϵ,respectively as shown in FIG. 10. The β, γ, δ, ϵ read address generation circuit 14 functions in writing the address from where storing correction coefficient starts from the CPU 1 to the latch 24.

A 2-bit counter 25 counts up at every actuation pulse generator from the CPU 1. Outputs from the counter 25 become a series of cycles (0, 1, 2, 3). An adder 26 adds the output of the latch 24 to the output of the counter 25.

Figure 11:
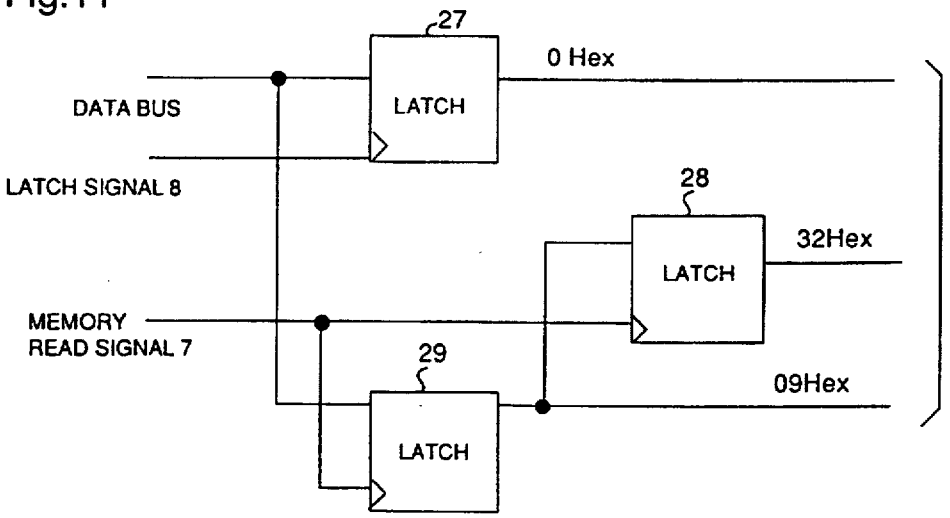
FIG. 11 is a block diagram of a read address generation circuit 20.

A reference numeral 20 is a read address generation circuit. FIG. 11 shows the read address generation circuit 20 for generating the read address of (f×R). More specifically in the correction read address generation circuit 20, the CPU 1 writes the index address bit of (f×R) to the latch 27. For example, in case of (f×R), 0 Hex is written to the latch 27. A latch 28 and a latch 29 contain the read result of f (32 Hex) and the read result of R (09 Hex) as read signals 7 of the memory control section 4, respectively. Then a read address 03209 Hex of (f×R) is formulated by binding outputs of the latches 27, 28 and 29.

The read address generation circuits of (β×b), (γ×c), (δ×d) and (ϵ×e) have likewise the same construction as shown in FIG. 11.

A reference numeral 17 is an address adjustment circuit. Prior to explaining the address adjustment circuit 17, power timing is described.

The selection and powering of each reference heating element occurs at intervals which span every 4 heating elements, as shown in FIG. 3, and is dependent on the order of the powering timing of the reference heating element. The power timing scheme must take into account the heat accumulation effects of heat on the reference heating element from heating element which are positioned on the current line, 1-line precedent line, or two-lines precedent line.

Figure 12:
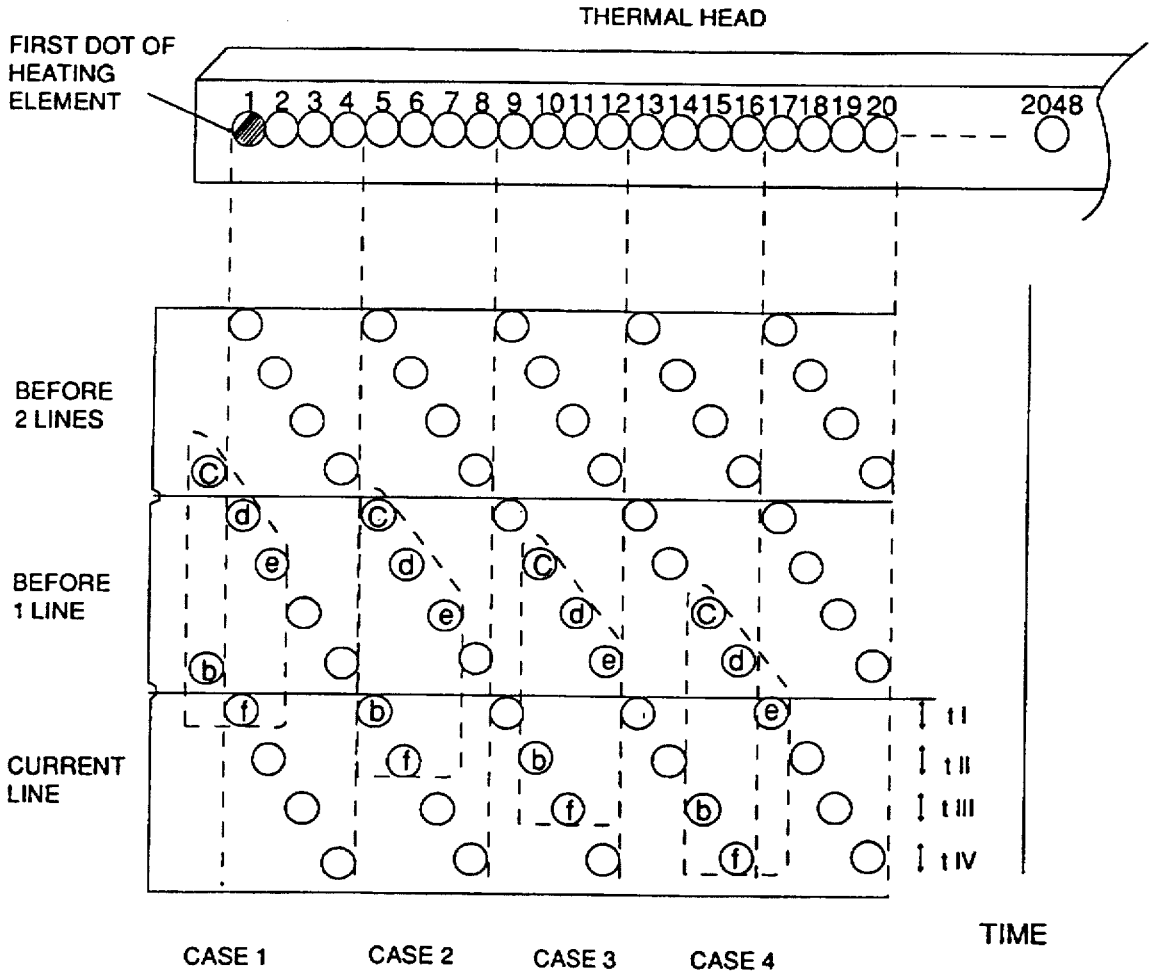
FIG. 12 illustrates a model view for showing selection of powering of a heating element.

FIG. 12 is a model view representing that the heating element of the thermal head is selected and powered at every 4 heating elements. Correction of the 1st, 5th, 9th, 13th, 17th, . . . heating elements which are powered at a timing tI is described with respect to the 1st heating element.

Figure 13:
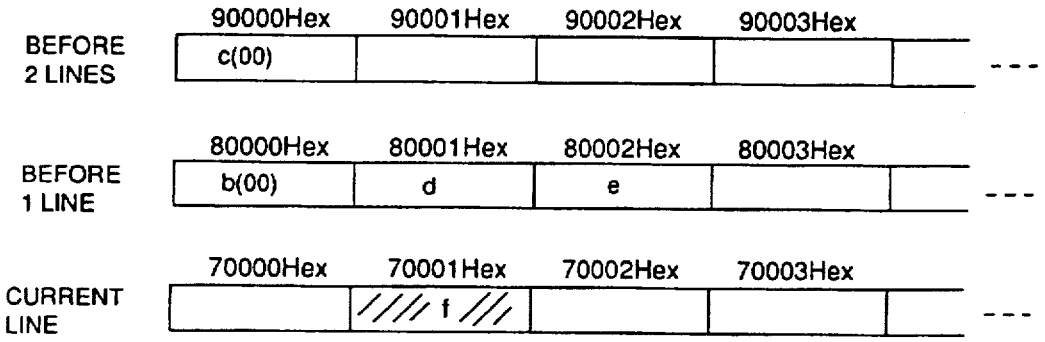
FIG. 13 is a figure for explaining a storing position of scale data.

When correcting the printing data (scale data) supplied to the 1st heating element, reference heating elements b, c, d and e, which are located at position encircled with a wave line shown by the case 1 of FIG. 12. The reference heating elements b, d and e locate on 1-line precedent and the reference heating element c locates on 2-lines precedent. Supposing that the scale data supplied to the 1st heating element is stored in 70001 Hex address as shown in Fig.13, the reference heating elements b, c, d and e are located as follows.

The scale data f locates on the current line at 70001 Hex address.

The reference heating element b locates on 1-line precedent at 80000 Hex address.

The reference heating element c locates on 2-lines precedent at 90000 Hex address.

The reference heating element d locates on 1-line precedent at 80001 Hex address.

The reference heating element e locates on 1-line precedent at 80002 Hex address.

As for the least significant bit of the address for storing each printing data:

The reference heating element b is stored in the address 1-address smaller than that for storing the scale data f (−1).

The reference heating element c is stored in the address 1-address smaller than that for storing the scale data f (−1).

The reference heating element d is stored in the same address as that for storing the scale data f.

The reference heating element e is stored in the address 1-address larger than that for storing the scale data f (+1)..

In this case, no reference heating elements b and c actually exist. So the scale data supplied to the 1st heating element is stored from 70001 Hex address, not from 70000 Hex. The reference heating elements b and c are supposed to be virtually located at 80000 Hex address and 90000 Hex, respectively. Since 80000 Hex and 90000 Hex addresses have been preliminarily cleared to zero, the equation (2) can be calculated (b=0, c=0) without difficulties.

Each store point of the reference heating elements b, c, d and e necessary for correcting the 1st, 5th, 9th, 13th, 17th . . . heating elements powered at t9 on the current line can be obtained with the case 1 in FIG. 12.

The method for selecting the reference heating element for correcting the printing data (scale data) supplied to the heating element to be powered at timing of tII, tIII and tIV are described in the similar manner.

Figure 14:
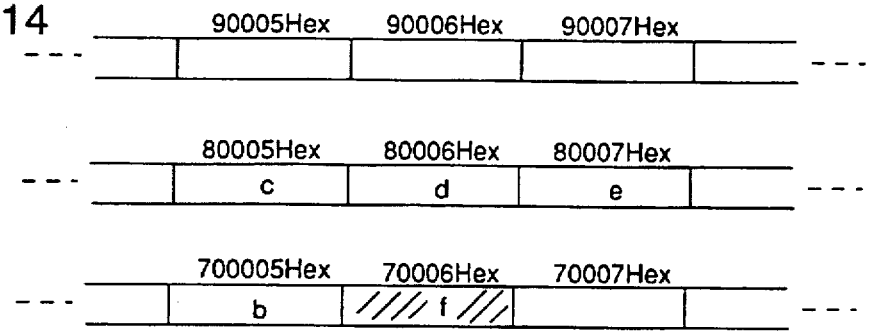
FIG. 14 is another figure for explaining a storing position of scale data.

In case of correcting the 2nd, 6th, 10th, 14th, 18th . . . heating elements powered at a timing tII, the relative location is identified by focusing on the least significant bit of the address for storing the reference heating elements in accordance with the case 2 of FIG. 12 and FIG. 14.

The reference heating element b is stored in the address 1-address smaller than the address for storing the f (−1).

The reference heating element c is stored in the address 1-address smaller than that for storing the scale data f (1).

The reference d is stored in the same address as that for storing the scale data f.

The reference heating element e is stored in the address 1-address larger than that for storing the scale data f (+1).

As a result, the reference heating elements b, c, d and e necessary for correcting the heating element to be powered at the timing tII on the current line are stored at points shown in FIG. 14.

Figure 15:
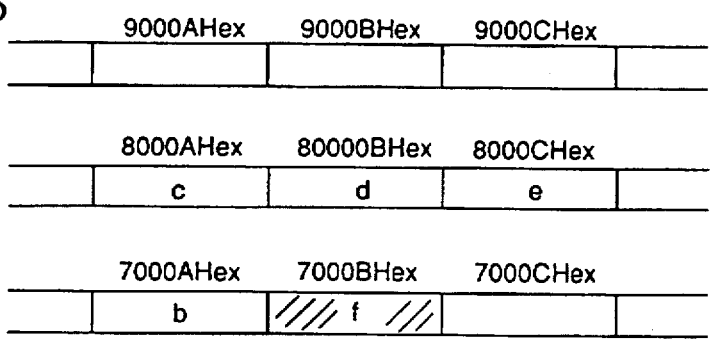
FIG. 15 is yet another figure for explaining a storing position of scale data.

In case of correcting the 3rd, 7th, 11th, 15th, 19th . . . heating elements powered at a timing tIII, the relative location is identified by focusing on the least significant bit of the address for storing the reference heating elements in accordance with the case 3 of FIG. 12 and FIG. 15.

The reference heating element b is stored in the address 1-address smaller than that for storing the scale data f (−1).

The reference heating element c is stored in the address 1-address smaller than that for storing the scale data f (−1).

The reference heating element d is stored in the same address as that for storing the scale data f.

The reference heating element e is stored in the address 1-address larger than that for storing f (+1).

As a result, the reference heating elements b, c, d and e necessary for correcting the 3rd, 7th, 11th, 15th, 19th . . . heating elements to be powered at the timing tIII on the current line are stored at points shown in FIG. 15.

Figure 16:
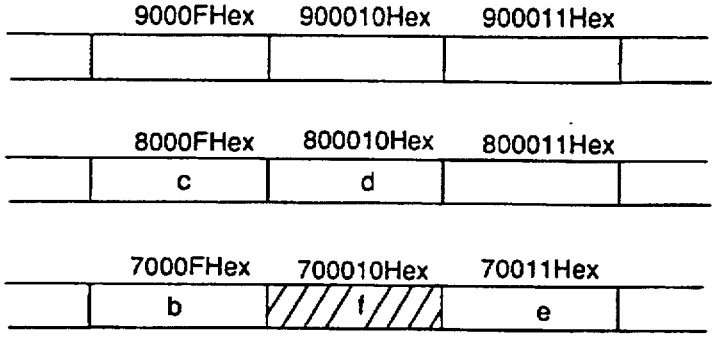
FIG. 16 is a figure for explaining storing position of scale data.

In case of correcting the 4th, 8th, 12th, 16th, 20th . . . heating elements powered at a timing tIV, the relative location is identified by focusing on th least significant bit of the address for storing the reference heating elements in accordance with the case 4 of FIG. 12 and FIG. 16.

The reference heating element b is stored in the address 1-address smaller than the address for storing the f (−1).

The reference heating element c is stored in the address 1-address smaller than that for storing the scale data f (−1).

The reference d is stored in the same address as that for storing the scale data f.

The reference heating element e is stored in the address 1-address larger than that for storing the scale data f (+1).

As a result, the reference heating elements b, c, d and e necessary for correcting the 4th, 8th, 12th, 16th, 20th . . . heating elements to be powered at the timing tIV on the current line are stored at points shown in FIG. 16.

Selection of the powering timing of the heating element and the reference heating element will be cyclic as shown in FIG. 17.

The read cycle judgment circuit 12 transmits the selection case of the heating element subjected to correction to an address adjustment circuit 17 in accordance with a selection signal S2.

The address adjustment circuit 17 outputs −1, +0, and +1 with the selection signal S2 dependent on the selected case.

The adder 18 adds an output of the address adjustment circuit 17 to the least significant bit of the output address of the line printing data read address generation circuit 13.

The relationship among the calculation procedure of the equation (2), read cycle and the address selection is shown below, using the example of correcting the 1st heating element shown in FIG. 12. [Read cycle], [Procedure], [Address output], [Read result]

1st read cycle, Read f, 70001 Hex, 32 Hex
2nd read cycle, Read R, 60001 Hex, 09 Hex
3rd read cycle, Read (f×R), 03209 Hex, XX Hex
4th read cycle, Read β, 00000 Hex, 03 Hex
5th read cycle, Read b, 80001 Hex, 00 Hex
6th read cycle, Read (β×b), 10300 Hex, XX Hex
7th read cycle, Read γ, 00001 Hex, 01 Hex
8th read cycle, Read c, 90000 Hex, 00 Hex
9th read cycle, Read (γ×c), 20100 Hex, XX Hex
10th read cycle, Read δ, 00002 Hex, 03 Hex
11th read cycle, Read d, 80000 Hex, 1F Hex
12th read cycle, Read (δ×d), 3031H Hex, XX Hex
13th read cycle, Read ε, 00003 Hex, 05 Hex
14th read cycle, Read e, 80002 Hex, 22 Hex
15th read cycle, Read (ε×e), 30522 Hex, XX Hex The memory control section 4 outputs 15 read signals 7 to the memory 2 upon receiving an actuation order pulse 5 from the CPU 1, and outputs 15 count pulses 6 to the address control section 3 for transmitting the current order of the read cycle.

The address generation section 3 outputs the f read address first and then R read address with the count pulse 6 as well as outputting a latch pulse 8 for latching the memory data of the read cycle of the above multiplication term to the arithmetic section 9.

Figures 18A, 18B, 18C, 18D, 18E:
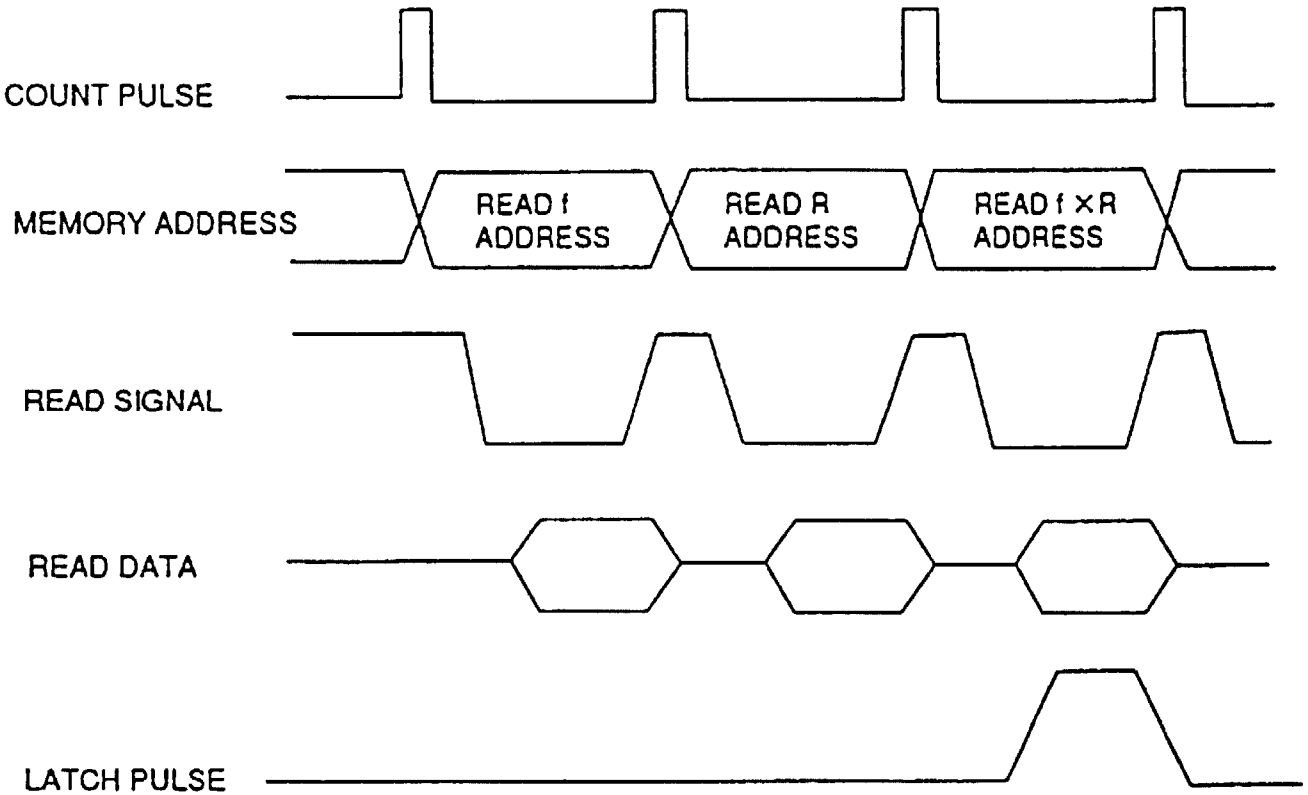
FIG. 18 is a figure for explaining a waveform in case that the one dot line printing powering timing is simultaneous in all dots.
Figure 19:
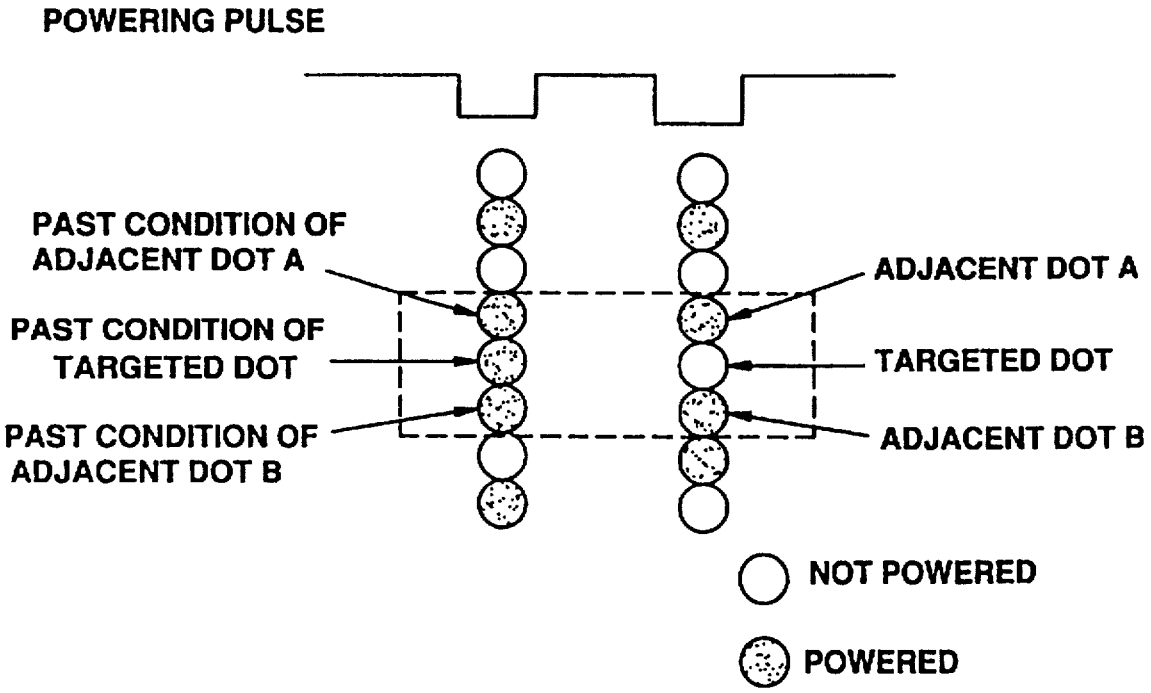
FIG. 19 PRIOR ART
FIG. 19 is a figure for explaining a prior art.

The arithmetic section 9 latches the (f×R) value output from the memory 2 with the first latch pulse 8. This arithmetic section 9 serves to subtract each read result of (β×b), (γ×c), (δ×d) and (ε×e) from the (f×R) value at every latch pulse 8 and further outputs the subtracted results f' to the data path and supplies a flag indicative of completion of calculation to the CPU 1. FIG. 18 shows signal waveforms of the respective sections The CPU writes the obtained f' in the same address as that prior to correction. If correction of the printing data (scale data) supplied to all the heating elements are completed, the memory area (70000 Hex to 7 FFFF Hex) as the current line is usable as the 1-line precedent. The memory area (80000 Hex to 8 FFFF Hex) used as the 1-line precedent is usable as the 2-lines precedent. The memory area (90000 Hex to 9 FFFF Hex) used as the 2-lines precedent is used to store new current line data. Using the memory area for 3 lines in cyclic manner reduces the memory size to minimum.

This embodiment controls energy supply by using resistance correction coefficient of the respective heating elements. However it is possible to define the energy value supplied to the targeted heating element by obtaining difference value between the energy value supplied to the targeted heating element (not corrected by the resistance correction coefficient) and correction energy value of the reference heating element. In this case, the printing accuracy is inferior to that of the present invention. However this allows the memory 2 to reduce its size as well as providing easy control.

It is also possible to construct the address generation section 3 and arithmetic section 9 so that a target value f' after calculating the heating history is automatically written to the memory, thus accelerating processing.

The respective parameters used in the present invention have been preliminary stored in Table, which are designed to automatically read out the parameters and output the corrected results at hardware side. Therefore applying this invention to various types of devices will not require re-writing the software but changing the stored parameters only. As a result, optimum heating history control is executable to the respective devices. The present invention allows high-speed processing compared with the software calculation, thus requiring only simple software program such as input/output instruction.

As described above, in a heating controller of the thermal head according to the present invention, heating accumulation influence parameters of the reference heating element and the past heating accumulation influence parameters of the targeted heating element can be individually set. So finer heating control considering each resistance value of the heating element is executed irrespective of a large number of heating elements.

The present invention is able to construct the heating control unit containing no analog element, thus eliminating parts for correcting temperature or voltage which have been required therefor. Such construction allows to formulate the LSI easily, resulting in minimizing the unit size and cost.

Accurate correction of the heating history is obtained by adding the data read from the memory for storing the correction energy values without complicated multiplication. This enables to improve printing quality as well as accelerating printing. This advantages serve to provide solutions for the conventional problems.

What is claimed is:

1. A control device which controls a supply of energy to heating elements of a thermal head, said control device controlling a supply of energy to a targeted heating element that prints by referring to heating histories of reference heating elements in the vicinity of said targeted heating element, said control device comprising:

storing means for storing multiplication results as correction energy values representing combinations of all influence parameters, each of said influence parameters indicating a degree of influence caused by a respective one of said reference heating elements on said targeted heating element, and all energy values which can be supplied to said reference heating elements; and reading means for specifying a reference heating element that affects said targeted heating element based on printing data, and reading out one of said correction energy values from said storing means based on a combination of one of said influence parameters of said reference heating element and a corresponding energy value supplied to said reference heating elements;

wherein each of said influence parameters is determined based on a clearance between said targeted heating elements and said reference heating element, and a time difference between a time when said reference heating element was last energized and a time when said targeted heating element is to be next energized.

2. The control device which controls a supply of energy to heating elements of a thermal head of claim 1, further comprising means for calculating a difference value between an energy value that is supplied to said targeted heating element and said correction energy value that has been read out with said reading means and outputting said difference value as an energy value that is to be supplied to said targeted heating element.

3. A control device which controls a supply of energy to heating elements of a thermal head, said control device controlling a supply of energy to a targeted heating element that prints by referring to heating histories of reference heating elements in the vicinity of said targeted heating element, said control device comprising:

storing means for storing multiplication results as correction energy values representing combinations of all influence parameters, each of said influence parameters indicating a degree of influence caused by a respective one of said reference heating elements on said targeted heating element, and all energy values which can be supplied to said reference heating elements; and reading means for specifying a reference heating element that affects said targeted heating element based on printing data, and reading out one of said correction energy values from said storing means based on a combination of one of said influence parameters of said reference heating element and a corresponding energy value supplied to said reference heating element;

wherein said storing means comprises:

a first storing section for storing at least one of said correction energy values that is a multiplication result of a combination of one of said influence parameters and a corresponding energy value of said all energy values which can be supplied to one of said reference heating elements at an address obtained from a combination of first numerical data corresponding to said influence parameter and second numerical data corresponding to said corresponding energy value;

a second storing section for storing said first numerical data corresponding to said one of said influence parameters; and a third storing section for storing third numerical data corresponding to an energy value that was supplied to one of said reference heating elements; and wherein said reading means comprises:

means for specifying said one of said reference heating elements based on printing data, reading out one of said first numerical data corresponding to an influence parameter of said one of said reference heating elements from said second storing section and said third numerical data corresponding to said energy value that was supplied to said one of said reference heating elements from said third storing section and generating an address from a combination of said first and third numerical data which were read out; and means for reading out a correction energy value from said first storing section based on said generated address.

4. A control device which controls a supply of energy to heating elements of a thermal head, said control device controlling a supply of energy to a targeted heating element that prints by referring to heating histories of reference heating elements in the vicinity of said targeted heating element, said control device comprising:

storing means for storing multiplication results as correction energy values representing combinations of all influence parameters, each of said influence parameters indicating a degree of influence caused by a respective one of said reference heating elements on said targeted heating element, and all energy values which can be supplied to said reference heating elements; and reading means for specifying a reference heating element that affects said targeted heating element based on printing data, and reading out one of said correction energy values from said storing means based on a combination of one of said influence parameters of said reference heating element and a corresponding energy value supplied to said reference heating element;

wherein said storing means comprises:

a first storing section for storing first numerical data, each of said first numerical data corresponding to one of said influence parameters;

a second storing section for storing second numerical data, each of said second numerical data corresponding to one of a first energy value of said all energy values which can be supplied to a reference heating element of said reference heating elements and a second energy value of all energy values which can be supplied to said targeted heating element;

a third storing section for storing third numerical data corresponding to a third energy value that was supplied to said reference heating element;

a fourth storing section for storing fourth numerical data, each of said fourth numerical data corresponding to a resistance correction coefficient of each heating element;

a fifth storing section for storing said correction energy value that is a multiplication result of a combination of said one of said influence parameters and said first energy value into an address obtained from a combination of said first numerical data corresponding to said one of said influence parameters and said second numerical data corresponding to said first energy value; and a sixth storing section for storing a resistance correction energy value that is a multiplication result of a combination of said resistance correction coefficient of said targeted heating element and said second energy value into an address obtained from a combination of said second numerical data corresponding to said second energy value and said fourth numerical data corresponding to said resistance correction coefficient corresponding to said targeted heating element; and wherein said reading means comprises:

means for specifying said targeted heating element based on printing data, reading out said third numerical data corresponding to an energy value that is supplied to said targeted heating element and said fourth numerical data corresponding to said resistance correction coefficient of said targeted heating element from said second and fourth storing sections and generating a first address based on a combination of said second and fourth numerical data which were read out;

means for specifying said reference heating element based on said printing data, reading out said first numerical data corresponding to an influence parameter of said reference heating element and said third numerical data corresponding to said third energy value that was supplied to said reference heating element from said first and third storing sections and generating a second address based on a combination of said first and third numerical data which were read out;

means for reading out said resistance correction energy value stored in said first address from said sixth storing section; and means for reading out said correction energy value stored in said second address from said fifth storing section;

means for calculating a difference value between said resistance correction energy value which was read out and said correction energy value which was read out and outputting said difference value as said energy value that is supplied to said targeted heating element.

5. A control device which controls a supply of energy to heating elements of a thermal head, said control device controlling a supply of energy to a targeted heating element that prints by referring to a heating history of reference heating elements in the vicinity of said targeted heating element, said control device comprising:

a first storing section for storing first numerical data, each of said first numerical data corresponding to an influence parameter that indicates a degree of an influence caused by one of said reference heating elements on said targeted heating element;

a second storing section for storing second numerical data, each of said second numerical data corresponding to one of a first energy value which can be supplied to said one of said reference heating elements and a second energy value which can be supplied to said targeted heating element;

a third storing section for storing third numerical data, each of said third numerical data corresponding to a third energy value that was supplied to said one of said reference heating elements;

a fourth storing section for storing fourth numerical data, each of said fourth numerical data corresponding to a resistance correction coefficient of one of said heating elements;

a fifth storing section for storing said correction energy value that is a multiplication result of a combination of said influence parameter and said first energy value into an address obtained from a combination of a first numerical data corresponding to said influence parameter and a second numerical data corresponding to said first energy value;

a sixth storing section for storing a resistance correction energy value that is a multiplication result of a combination of a resistance correction coefficient of said targeted heating element and said second energy value into an address obtained from a combination of said second numerical data corresponding to said second energy value and said fourth numerical data corresponding to said resistance correction coefficient of said targeted heating element;

means for specifying said targeted heating element based on printing data, reading out said second numerical data corresponding to an energy value that is supplied to said targeted heating element and said fourth numerical data corresponding to said resistance correction coefficient of said targeted heating element from said second and fourth storing sections and generating a first address based on a combination of said second and fourth numerical data which were read out;

means for specifying said reference heating element based on said printing data, reading out said first numerical data corresponding to an influence parameter of said reference heating element and said third numerical data corresponding to said third energy value that was supplied to said reference heating element from said first and third storing sections and generating a second address based on a combination of said first and third numerical data which were read out;

means for reading out said correction energy value stored in said second address from said fifth storing section;

means for reading out said resistance correction energy value stored in said first address from said sixth storing section; and means for calculating a difference value between said resistance correction energy value which was read out and said correction energy value which was read out and outputting said difference value as said energy value that is supplied to said targeted heating element.

6. The control device which controls a supply of energy to heating elements of a thermal head of claim 5, wherein each of said influence parameters is determined based on a clearance between said targeted heating element and said reference heating element and a time difference between a time when said reference heating element was energized and a time when said targeted heating element is energized.

7. A method for controlling a supply of energy to heating elements of a thermal head by referring to a heating history of reference heating elements in the vicinity of a targeted heating element, said method comprising steps of:

converting all energy values that can be supplied to said heating elements to first numerical data;

converting all influence parameters, each of said influence parameters indicating a degree of influence caused by a respective one of said reference heating elements on said targeted heating element, to second numerical data and storing a result;

storing each of a plurality of correction energy values that are multiplication results of combinations of all influence parameters and all energy values which can be supplied to said reference heating elements at an address obtained from a combination of one of said first numerical data and one of said second numerical data as a first correction energy value;

converting all energy values supplied to said reference heating elements to said first numerical data and storing a result;

reading out one of said first numerical data corresponding to an energy value supplied to a reference heating element specified by printing data and one of said second numerical data corresponding to an influence parameter of said specified reference heating element;

generating an address from a combination of said one of said first numerical data and said one of said second numerical data which were read out;

reading out one of said correction energy values based on said generated address; and calculating a difference value between an energy value that is to be supplied to said targeted heating element and said correction energy value which is read out and determining said difference value as an energy value to be supplied to said targeted heating element.

8. The method for controlling a supply of energy to heating elements of a thermal head of claim 7, wherein each of said influence parameters is determined based on a clearance between said targeted heating element and said energized reference heating element and a time difference between a time when said reference heating element was energized and a time when said targeted heating element is energized.

9. A method for controlling a supply of energy to heating elements of a thermal head by referring to a heating history of reference heating elements in the vicinity of a targeted heating element, said method comprising steps of:

converting all energy values that can be supplied to said heating elements to first numerical data and storing a result;

converting all influence parameters, each of said influence parameters indicating a degree of influence caused by a respective one of said reference heating elements on said targeted heating element, to a second numerical data and storing a result;

converting resistance correction coefficients of said heating elements to third numerical data and storing a result;

storing each of a plurality of first correction energy values that are multiplication results of combinations of all influence parameters and all energy values associated with said reference heating elements at an address obtained from a combination of one of said first numerical data and one of said second numerical data;

storing each of a plurality of second correction energy values that are multiplication results of combinations of all resistance correction coefficients and all energy values associated with said targeted heating elements at an address obtained from a combination of one of said first numerical data and one of said third numerical data;

converting all energy values supplied to said reference heating elements to said first numerical data and storing a result;

reading out one of said first numerical data corresponding to an energy value supplied to a reference heating element specified by printing data and one of said second numerical data corresponding to an influence parameter of said specified reference heating element;

generating a first address based on a combination of said first numerical data and said second numerical data which were read out and reading out a first correction energy value based on said first address;

reading out a first numerical data corresponding to an energy value that is supplied to a targeted heating element specified by printing data and a third numerical data corresponding to a resistance correction coefficient of said specified targeted heating element;

generating a second address from a combination of said first numerical data and said third numerical data which were read out and reading out a second correction energy value based on said second address; and calculating a difference value between said first correction energy value and said second correction energy value which were read out and determining said difference value as an energy value to be supplied to said targeted heating element.

10. The method for controlling a supply of energy to heating elements of a thermal head of claim 9, wherein each of said influence parameters is determined based on a clearance between said targeted heating element and said energized reference heating element and a time difference between a time when said reference heating element was energized and a time when said targeted heating element is energized.

* * * * *